US011708249B2

(12) United States Patent
Keilhauer et al.

(10) Patent No.: US 11,708,249 B2
(45) Date of Patent: Jul. 25, 2023

(54) METHOD FOR OPERATING A CRANE, AND CRANE

(71) Applicant: TADANO FAUN GmbH, Lauf a. d. Pegnitz (DE)

(72) Inventors: David Keilhauer, Nuremberg (DE); Tobias Ebinger, Lauf (DE); Dennis Skudlarek, Lauf an der Pegnitz (DE)

(73) Assignee: TADANO FAUN GmbH, Lauf A. D. Pegnitz (DE)

( * ) Notice: Subject to any disclaimer, the term of this patent is extended or adjusted under 35 U.S.C. 154(b) by 33 days.

(21) Appl. No.: 17/541,656

(22) Filed: Dec. 3, 2021

(65) Prior Publication Data

US 2022/0177283 A1 Jun. 9, 2022

(30) Foreign Application Priority Data

Dec. 3, 2020 (DE) ..... 10 2020 215 260.8

(51) Int. Cl.
*B66C 23/82* (2006.01)
*B66C 23/70* (2006.01)
*B66C 13/18* (2006.01)

(52) U.S. Cl.
CPC ..... *B66C 23/828* (2013.01); *B66C 13/18* (2013.01); *B66C 23/701* (2013.01); *B66D 2700/01* (2013.01)

(58) Field of Classification Search
CPC .... B66C 23/828; B66C 23/701; B66C 23/826
See application file for complete search history.

(56) References Cited

U.S. PATENT DOCUMENTS 6,550,624 B1 * 4/2003 Irsh ..... B66C 23/823 52/118
7,137,518 B2 * 11/2006 Irsch ..... B66C 23/828 52/118
7,213,717 B2 * 5/2007 Willim ..... B66C 23/826 212/348

(Continued)

FOREIGN PATENT DOCUMENTS

EP 1065166 B2 2/2009
JP 2005162392 A * 6/2005 ..... B66C 23/702

(Continued)

OTHER PUBLICATIONS

JP 2005/162392A Machine Translation (Year: 2005).*

(Continued)

*Primary Examiner* — Michael R Mansen
*Assistant Examiner* — Juan J Campos, Jr.
(74) *Attorney, Agent, or Firm* — Laurence A. Greenberg; Werner H. Stemer; Ralph E. Locher

(57) ABSTRACT

A crane, in particular a mobile crane, includes a crane jib which can be moved about a substantially horizontal luffing axis, and a tensioning device for the crane jib. The tensioning device includes two pendants which run from the jib tip to the jib base of the crane jib and tensioning posts each tensioning a respective one of the pendants relative to the crane jib in a triangular configuration. In order to operate the crane, a luffing angle of the crane jib about the luffing axis is measured or recorded, and a spread angle between the tensioning posts while the crane jib is being used is modified depending on the luffing angle.

10 Claims, 5 Drawing Sheets

(56) References Cited

U.S. PATENT DOCUMENTS

| | | | | |
|---|---|---|---|---|
| 2004/0040926 | A1* | 3/2004 | Irsch | B66C 23/828<br>212/347 |
| 2004/0129663 | A1* | 7/2004 | Willim | B66C 23/701<br>212/177 |

FOREIGN PATENT DOCUMENTS

| | | | | |
|---|---|---|---|---|
| JP | 2006273530 | A * | 10/2006 | B66C 23/828 |
| JP | 2006306533 | A * | 11/2006 | B66C 23/828 |

OTHER PUBLICATIONS

JP 2006/273530A Machine Translation (Year: 2006).*
JP 2006/306533A Machine Translation (Year: 2006).*
EP 1,065,166 Machine Translation (Year: 2009).*

* cited by examiner

METHOD FOR OPERATING A CRANE, AND CRANE

CROSS-REFERENCE TO RELATED APPLICATION

This application claims the priority, under 35 U.S.C. § 119, of German Patent Application DE 10 2020 215 260.8, filed Dec. 3, 2020; the prior application is herewith incorporated by reference in its entirety.

FIELD AND BACKGROUND OF THE INVENTION

The invention relates to a crane, in particular a mobile crane, which has a crane jib which can be moved (i.e. can be inclined or luffed) about a luffing axis which is usually oriented horizontally. The invention moreover relates to a method for operating such a crane.

As is known, cranes serve to handle loads on construction sites, usually in the form of (revolving) tower cranes or also mobile cranes. The former are erected on a stationary erection site and usually remain in this place during the construction work. In contrast, mobile cranes usually have a self-propelled frame (usually referred to as the "undercarriage") on which a usually telescopic crane jib or a lattice boom jib is disposed in such a way that it can be slewed and its inclination can also be adjusted (can be "luffed"). Mobile cranes are consequently very flexible and can thus, as required, also be erected on the construction site for just a short period of time, for example in order to build a tower crane or in the case of short deployment times where it would be too expensive to build a tower crane.

Mobile cranes can in particular often be adapted relatively flexibly to different deployment scenarios by, for example, different attachment elements being used. Thus, for example, the reach, both horizontally and vertically, can be increased by the use of a tip attachment. Mobile cranes often carry a "simple" tip attachment on board. Its length is approximately that of a jib element (i.e. a segment of a telescopic crane jib). In contrast, larger, i.e. in particular longer tip attachments, are usually transported separately. In order to increase the weight which can be lifted by the crane jib, tensioning cable devices are often used which run on a rear side of the crane jib and counteract bending of the crane jib under load. Those tensioning cable devices usually have two pendants which run from the jib tip to the jib base and are tensioned relative to the crane jib by using so-called tensioning posts in a triangular configuration.

SUMMARY OF THE INVENTION

It is accordingly an object of the invention to provide a method for operating a crane and a crane, which overcome the hereinafore-mentioned disadvantages of the heretofore-known methods and cranes of this general type and which improve the operation of a crane.

This object is achieved according to the invention by a method for operating a crane. This object is furthermore achieved by a crane, in particular a mobile crane. Advantageous embodiments and developments of the invention which partially represent an inventive step per se are recited in the dependent claims and explained in the following description.

The method according to the invention serves to operate a crane, in particular a mobile crane. The crane which is operated by the method in this case has a crane jib which can be moved ("luffed") about a luffing axis lying (at least in the proper operating state) more or less or substantially horizontally (preferably exactly but possibly also "only" approximately, i.e. with a variance of +/−5 degrees, depending on the erection site and the like, at least in the proper operating state). The crane furthermore has a tensioning device for this crane jib. This tensioning device in this case includes two pendants which run from the jib tip to the jib base of the crane jib and in each case one tensioning post through the use of which the pendants are tensioned relative to the crane jib in a triangular configuration.

According to the method, a luffing angle of the crane jib about the luffing axis is measured during the operation of the crane. In other words, a current value for the inclination of the crane jib is measured. A spread angle between the tensioning posts is in this case modified during the use of the crane jib at least depending on the luffing angle. The spread angle is in particular in this case modified for the purpose of stabilizing the crane jib.

Since the spread angle between the tensioning posts is variable, it can be adapted to the inclination, i.e. the value of the luffing angle. As is known, the bending load of the crane jib increases at a small luffing angle, i.e. when the crane jib approaches the horizontal with its longitudinal extent, because the force of the weight (due to its dead weight and the working load picked up) acts almost perpendicularly to the crane jib. The steeper the angle at which the crane jib stands (in particular is therefore "luffed up"), the higher the compressive load (and correspondingly the lower the bending load) due to the weight and there is an additional risk of the crane jib buckling, in particular transversely to the luffing plane. By adjusting the spread angle depending on the luffing angle while the crane jib is being used, the stability of the crane jib can thus advantageously be adapted to the currently existing luffing angle and hence to the current load, and hence can be improved.

The crane jib in particular has a prismatic structure, preferably more or less with a rectangular cross-section, wherein a long axis of the cross-section expediently lies parallel to the luffing plane in order to obtain the highest possible bending modulus.

In a preferred variant of the method, the spread angle is modified continuously, preferably steplessly. Alternatively, the tensioning posts are articulated on the crane jib in such a way that they can be adjusted over multiple, at least five but preferably more, discrete spread positions in such a way that stepless adjustment is approximated.

Such a continuous adjustment of the spread angle has the advantage that there is no need to resort to individual load capacity charts drawn up for specific crane configurations and instead the crane can at all times be operated within a range with the highest possible load capacity. In other words, the (possible) load capacity of the crane can be modified dynamically and a comparatively heavier working load can be handled over a range of movement that is greater than in the prior art.

The spread angle is expediently increased as the luffing angle increases, i.e. the steeper the position of the crane jib. As a result, the "triangle" formed by the tensioning cable and tensioning post is "folded out" further and further to the side. The stability of the crane jib with respect to buckling is consequently increased, while its ability to bend in the luffing plane is reduced.

In an expedient variant of the method, the length of the crane jib, possibly including a jib extension (often also referred to as a "derrick tip" or the like) is measured. In this variant of the method, the spread angle between the tensioning posts is additionally also modified depending on the length of the crane jib. For example, in this case, for relatively long crane jibs with high values for the luffing angle, the spread angle is increased disproportionately relative to short crane jibs.

Where the above-described jib extension can be inclined relative to the crane jib (in particular, where it is constructed as a so-called "luffing tip"), the angle of inclination of this luffing tip to the crane jib is optionally also taken into consideration when setting the spread angle. For example, in the case of a relatively high luffing angle of the crane jib but a high angle of inclination of the luffing tip (in particular toward the ground), the spread angle between the tensioning posts can be kept smaller than in the case of a luffing tip which is aligned with the crane jib or where there is no luffing tip.

In a further expedient variant of the method, additionally or alternatively to the length of the crane jib, the weight of the working load lifted by the crane jib is measured. This weight is in this case (possibly also) taken into consideration when determining the spread angle to be set. In other words, in this case the spread angle is additionally also modified depending on the weight.

A deflection curve for the current configuration (in particular therefore the length of the crane jib, optionally including a jib extension) is, for example, calculated and the required orientation of the tensioning posts derived therefrom. The orientation of the crane jib in space, its length, and the load all influence the deflection curve. Put simply, in particular the tensioning posts can in this case can be spread further, the lower the calculated bending load (in the luffing plane).

In an optional variant of the method, the wind load on the crane jib, in particular also the direction of the wind, is also calculated. Thus, for example in the case of a side wind, the transverse load on the crane jib is increased in such a way that, in particular in the case of a steeply luffed crane jib, the spread angle is expediently increased further than when there is "calm air."

In a further optional variant of the method, the tension of the pendants is modified by using a tensioning winch depending on the spread angle, the luffing angle, the length of the crane jib, and/or the weight of the working load. As is known, the tension of the pendants influences the section modulus of the crane jib. In this case, the tension of the pendants is, for example, increased or alternatively reduced by using a tensioning winch.

The crane according to the invention is configured so as to be operated according to the above-described method. The crane, which is preferably a mobile crane, has, as described above, the crane jib which can be moved about a luffing axis lying more or less or substantially horizontally (preferably exactly but possibly also "only" approximately, i.e. with a variance of +/−5 degrees, depending on the erection site and the like, in the proper operating state). The crane moreover has the above-mentioned tensioning device for the crane jib which has the two pendants running from the jib tip to the jib base of the crane jib and in each case one tensioning post through the use of which the pendants are tensioned relative to the crane jib in a triangular configuration. The crane furthermore has a controller which is configured to measure the luffing angle of the crane jib and modify the spread angle between the tensioning posts while the crane jib is being used (at least) depending on the luffing angle. In other words, the controller is configured to perform the above-described method in particular automatically, optionally with the interaction of an operator (for example, a crane driver).

The method according to the invention and the crane according to the invention thus share the features described here and below—the crane in particular shares the physical features resulting from the description of the method—and the advantages.

In a preferred embodiment, the crane has an in particular hydraulic spreading drive which is configured to continuously vary the spread angle. The spreading drive is preferably a hydraulic cylinder, optionally with a controllable blocking valve which serves to block the hydraulic cylinder in any position and hence to be able to maintain the tensioning posts in their current spread position.

In an expedient embodiment, the tensioning posts are articulated in such a way that they are articulated so that they can be spread relative to each other only within a plane oriented radially with respect to the crane jib.

The crane expediently has a sensor system in order to calculate the length of the crane jib, the weight of the working load picked up, and/or possibly also the wind load. The controller is optionally configured to calculate the length of the crane jib during the configuration of the crane with the aid of data input by an operator.

In a further expedient embodiment, the crane has the above-described tensioning winch in order to vary the tension of the pendants. The controller is in this case configured so as to control the tensioning winch in order to vary the tension of the pendants while the crane jib is being used.

In a preferred embodiment, the controller is formed at least in the crane by a microcontroller with a processor and a memory by the functionality to perform the method according to the invention being implemented programmatically in the form of operating software (firmware) in such a way that the method is performed automatically, possibly with the interaction of an operator, when the operating software runs in the microcontroller. Within the context of the invention, the controller can, however, alternatively also be formed by a non-programmable electronic component, for example an ASIC, by the functionality to perform the method according to the invention being implemented with circuitry.

Other features which are considered as characteristic for the invention are set forth in the appended claims.

Although the invention is illustrated and described herein as embodied in a method for operating a crane and a crane, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
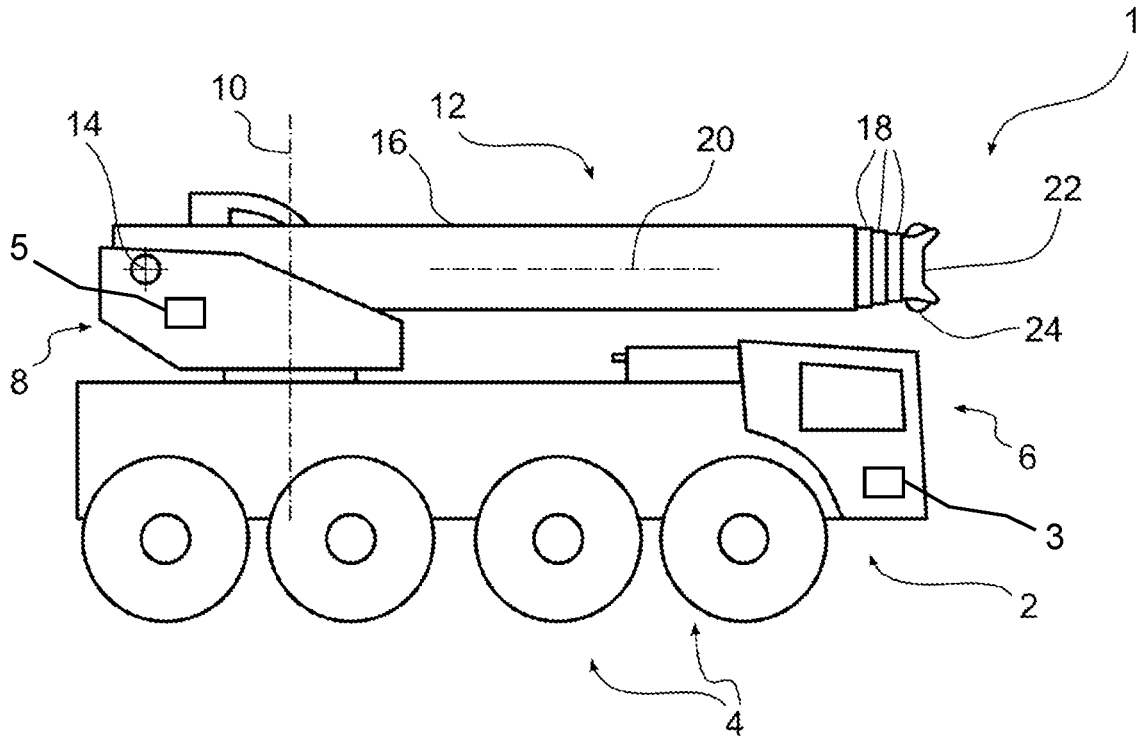
FIG. 1 is a diagrammatic, side-elevational view of a mobile crane with a crane jib.

Referring now in detail to the figures of the drawings, in which mutually corresponding parts and dimensions are always provided with the same reference symbols, and first, particularly, to FIG. 1 thereof, there is seen a crane, specifically a mobile crane 1, which is diagrammatically illustrated. The crane includes an undercarriage 2 which in turn has a chassis with a plurality of axles carrying wheels 4, and a cab 6. The mobile crane 1 moreover includes a superstructure 8 which is articulated on the undercarriage 2 so that it can be slewed about a vertical axis 10. The mobile crane 1 moreover includes a crane jib 12 which forms a part of the superstructure 8 and is articulated on a mounting of the superstructure 8 so that it can be swiveled (can be "luffed", i.e. its inclination can be adjusted) about a luffing axis 14. The crane jib 12 is telescopic and for this purpose has a base segment 16 in which a plurality of jib segments 18, each of which has a reduced cross-section, are accommodated so that they can be displaced along a longitudinal axis 20 of the crane jib 12. The "last" or smallest jib segment 18 in this case carries a so-called pulley head 22 on which a plurality of pulley wheels 24 of a pulley block are disposed.

Figure 2:
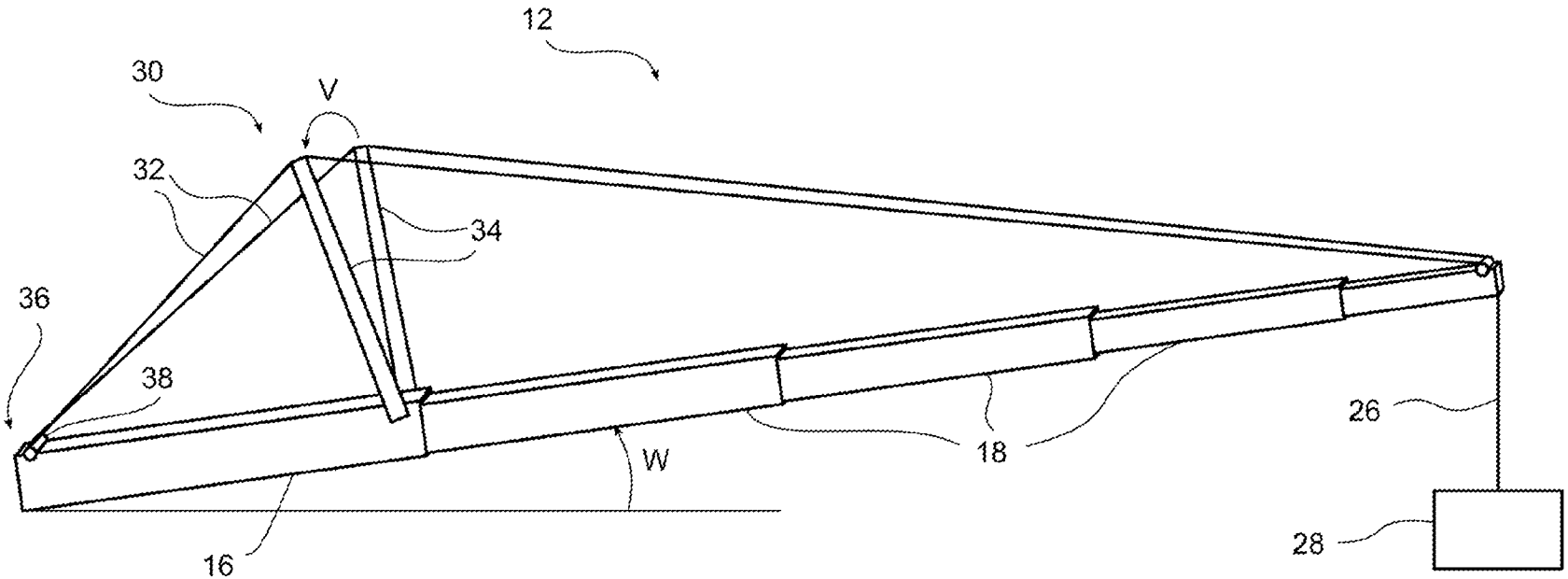
FIG. 2 is a side-perspective view of the crane jib with a jib extension in a first luffed position and a working load which has been picked up.

In proper operation of the crane, a crane cable 26 for lifting a (working) load 28 is guided over the pulley head 22. This is illustrated by way of example in FIG. 2, wherein the crane jib 12 is pictured on its own. The crane jib 12 is in this case inclined upward about the luffing axis 14 by a luffing angle W. Because of its dead weight and the weight of the load 28, the crane jib 12 is subject to a bending moment which causes a deflection in the luffing plane within which the luffing angle W also lies. The crane jib 12 has a tensioning device 30 in order to stabilize the crane jib with respect to this deflection. The tensioning device 30 includes two pendants 32 and two tensioning posts 34. The pendants 32 are attached, at least approximately, to the jib base 36 and to the jib tip, i.e. in the region of the pulley head 22, and are in each case tensioned by the associated tensioning post 34, oriented in this case at right angles to the crane jib 12, with respect to the crane jib 12 in a triangular configuration. A merely diagrammatically indicated tensioning winch 38 for the pendants 32 is disposed in this case at the jib base 36, and through the use of which the tensioning of the pendants 32 can be set.

The tensioning posts 34 are articulated on the crane jib 12, in the present exemplary embodiment specifically on the base segment 16, in a hinged fashion and so that they can be adjusted relative to each other within a radial plane with respect to the crane jib 12. An actuator 5, which in the present exemplary embodiment is formed by a hydraulic cylinder, is in this case associated with the tensioning posts 34. This actuator 5 effects adjustment, specifically V-shaped spreading between the two tensioning posts 34, illustrated in FIGS. 2 to 5 by a spread angle V. The actuator 5 is therefore referred to as a "spreading drive." The actuator 5 is in this case configured to enable continuous setting of the spread angle V. For this purpose, the actuator also includes a fixing device which locks the tensioning posts 34 in their current position. They can, for example, in this case be brakes or can define the hydraulic pressure in the above-mentioned hydraulic cylinder, in particular by using a correspondingly controllable blocking valve.

The mobile crane 1 includes a control unit 3 (also referred to as a "controller") which is configured to automatically perform a method described in detail below, optionally with the interaction of an operator of the mobile crane 1.

The control unit 3 in this case calculates the current luffing angle W. The (current value of the) luffing angle W is optionally calculated in this case with the aid of an (extended) position of a (hydraulic) luffing cylinder (not shown), through the use of which the crane jib 12 is inclined, i.e. "luffed." Alternatively, the mobile crane 1 has an inclination sensor (not shown) on the crane jib 12, through the use of which a value, measured by sensors, for the luffing angle W can be measured.

In a simple method, the control unit 3 controls the actuator 5 for the tensioning posts 34 in such a way that, while the crane jib 12 is being used (i.e. during the handling of the load 28, the luffing, or the like), as the luffing angle W increases, the spread angle V is likewise increased (see FIGS. 2 to 5).

Figure 3:
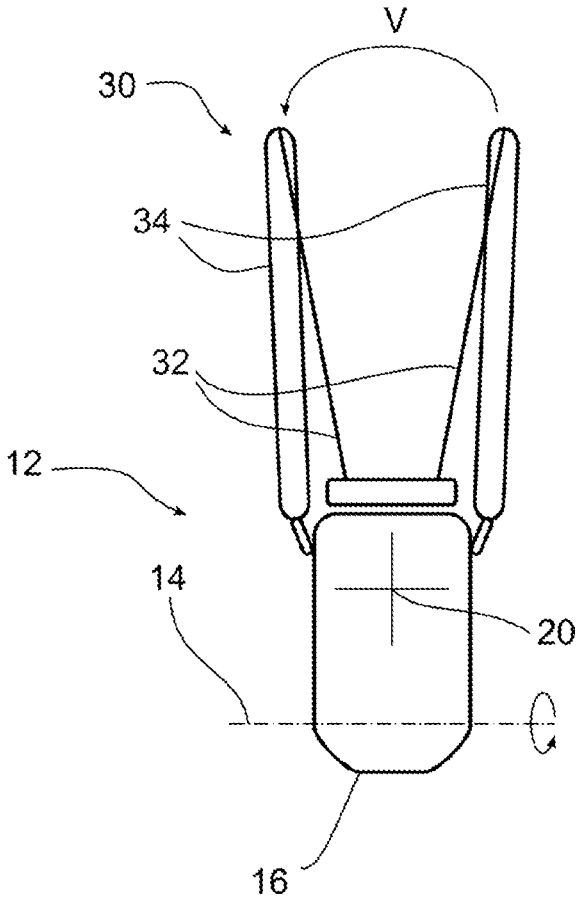
FIG. 3 is a partial elevational view of the crane jib taken along a longitudinal axis of the crane jib, in the direction of the jib tip.
Figure 4:
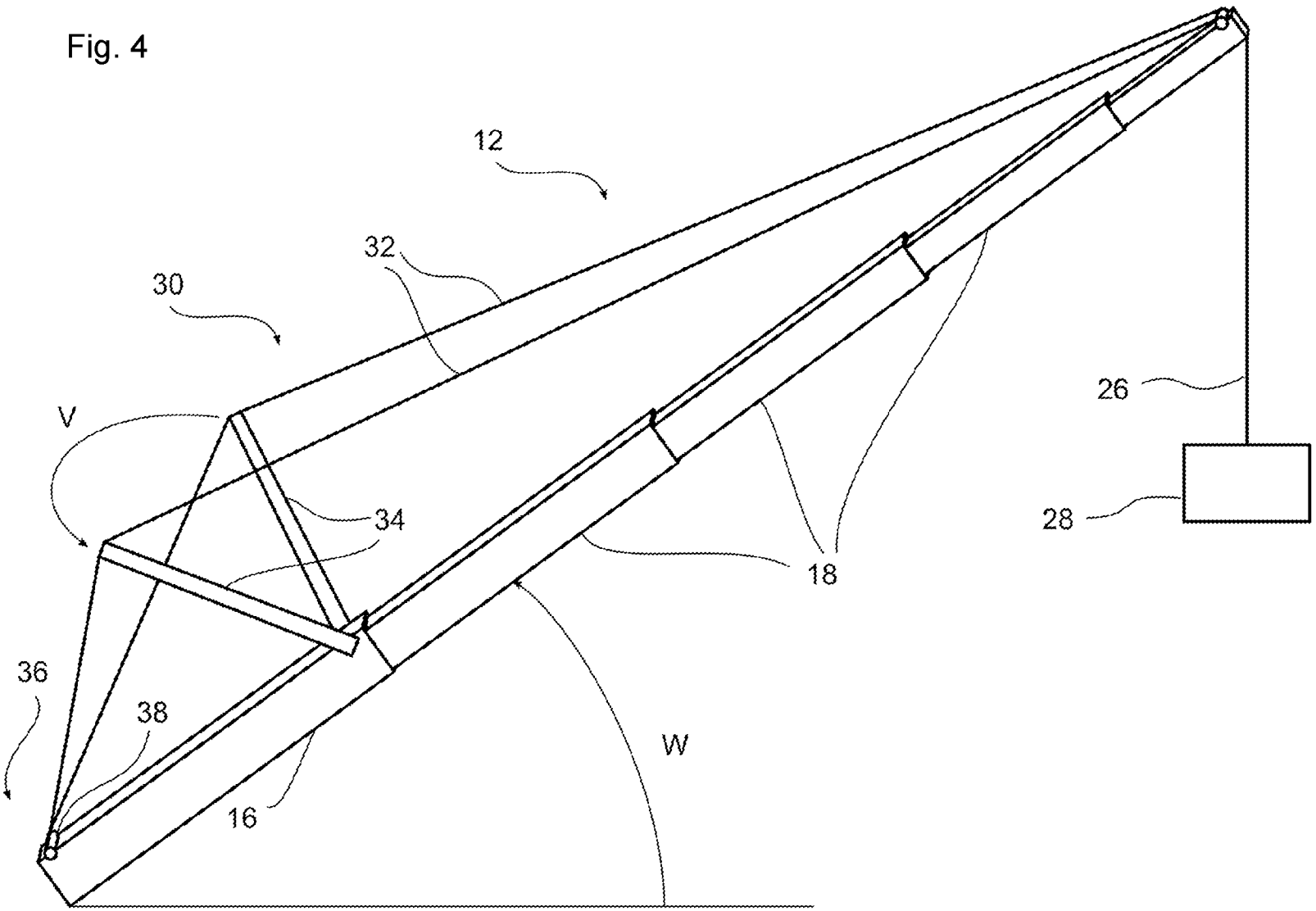
FIG. 4 is a view similar to FIG. 2 showing the crane jib in a second luffed position, with a greater luffing angle than in FIG. 2.
Figure 5:
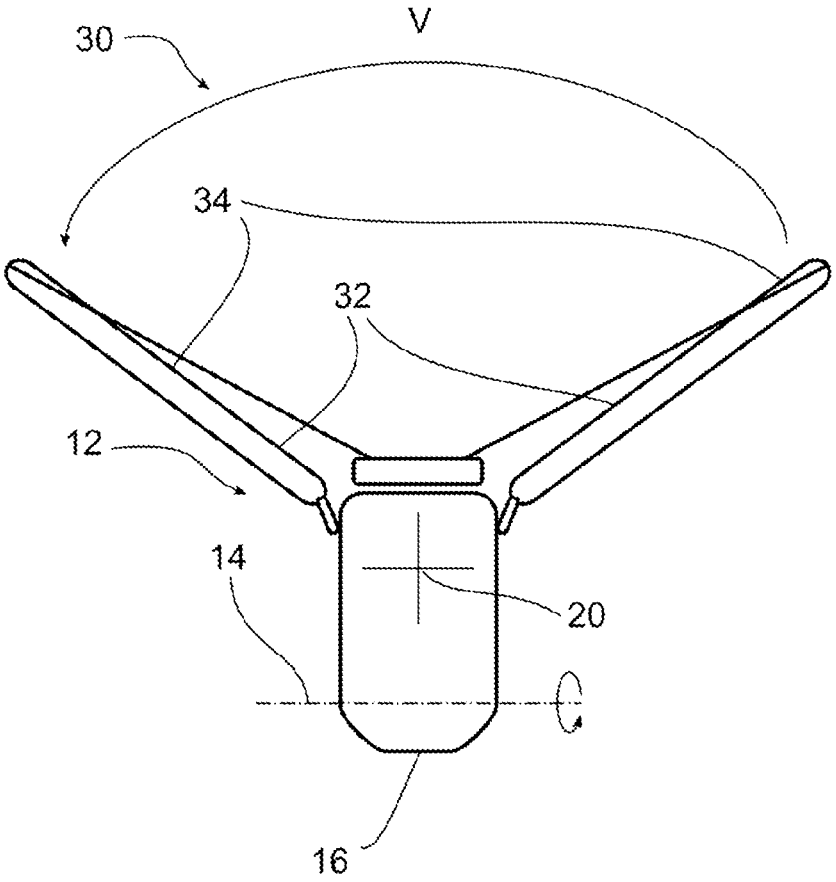
FIG. 5 is a view similar to FIG. 3 showing the crane jib in the second luffed position.

The background to this is that the above-described load-induced deflection decreases as the luffing angle W increases because the resulting torque is reduced. In the case of an untentioned jib, the risk of the jib buckling in this case increases, for example according to the known Euler cases, in particular to the side because the crane jib 12 has, as can be seen in FIG. 3, a rectangular cross-section, the long axis of which is oriented in the direction of gravity, i.e. parallel to the luffing plane. This risk can be counteracted by the increasing spreading of the tensioning posts 34 and this advantageously takes place during ongoing operation by the stiffness being reduced within the luffing plane and being increased transversely to the luffing plane.

In a further exemplary embodiment, the control unit 3 calculates the current length of the crane jib 12 in addition to the luffing angle W. This can usually be read from a memory of the control unit because it is a value which is optionally likewise variable during ongoing operation. Otherwise, the currently configured jib length, i.e. specifically for the current work of the crane, is likewise stored in the memory.

The control unit 3 moreover also calculates the weight of the lifted load 28. The tensioning posts 34 are adjusted (spread) in this case depending on the luffing angle W, the jib length, and the weight of the load 28.

For example, where the crane jib 12 is telescoped out to a relatively great length, the tensioning posts 34 are spread only in the case of a relatively high luffing angle W.

Exemplary values for the spread angle V are 0 degrees in the case of a luffing angle W of 10 degrees, 70 degrees in the case of a luffing angle W of 50 degrees, and 120 degrees in the case of a luffing angle W of 80 degrees.

In an optional exemplary embodiment, the mobile crane 1 has a wind sensor (not illustrated), through the use of which the control unit calculates the wind load acting on the crane jib 12. The control unit 3 in this case controls the actuator 5 in such a way that the tensioning posts 34 are spread further in the case of a side wind than in the case of wind in the luffing plane.

The subject of the invention is not limited to the above-described exemplary embodiments. Instead, further embodiments of the invention can be derived from the above description by a person skilled in the art.

The following is a summary list of reference numerals and the corresponding structure used in the above description of the invention.

LIST OF REFERENCE SYMBOLS

1 mobile crane
2 undercarriage
3 controller
4 wheel
5 spreading drive
6 cab
8 superstructure
10 vertical axis
12 crane jib
14 luffing axis
16 base segment
18 jib segment
20 longitudinal axis
22 pulley head
24 pulley
26 crane cable
28 working load
30 tensioning device
32 pendant
34 tensioning post
36 jib base
38 tensioning winch
V spread angle
W luffing angle

The invention claimed is:

1. A method for operating a crane or a mobile crane, the method comprising:

providing a crane jib being movable about a substantially horizontal luffing axis, and a crane jib tensioning device including two pendants running from a jib tip to a jib base of the crane jib and tensioning posts each tensioning a respective one of the pendants relative to the crane jib in a triangular configuration;

recording a luffing angle of the crane jib about the luffing axis; and modifying a spread angle between the tensioning posts while using the crane jib in dependence on the luffing angle.

2. The method according to claim 1, which further comprises continuously modifying the spread angle.

3. The method according to claim 1, which further comprises increasing the spread angle as the luffing angle increases.

4. The method according to claim 1, which further comprises measuring a length of the crane jib with or without a jib extension, and additionally also modifying the spread angle in dependence on the length of the crane jib.

5. The method according to claim 1, which further comprises measuring a weight of a working load lifted by the crane jib, and additionally also modifying the spread angle in dependence on the weight.

6. The method according to claim 1, which further comprises using a tensioning winch to modify the tension of the pendants in dependence on at least one of the spread angle, the luffing angle, a length of the crane jib or a weight of a working load lifted by the crane jib.

7. A crane or mobile crane, comprising:

a crane jib being movable about a substantially horizontal luffing axis, said crane jib having a jib tip and a jib base;

a tensioning device for said crane jib, said tensioning device having two pendants running from said jib tip to said jib base and tensioning posts each tensioning a respective one of said pendants relative to said crane jib in a triangular configuration; and a controller configured to detect a luffing angle of said crane jib about said luffing axis and to modify a spread angle between said tensioning posts in dependence on said luffing angle during use of said crane jib.

8. The crane according to claim 7, which further comprises a spreading drive or hydraulic spreading drive configured to continuously vary said spread angle.

9. The crane according to claim 8, wherein said tensioning posts are articulated so as to only permit said tensioning posts to be spread relative to each other within a plane oriented radially relative to said crane jib.

10. The crane according to claim 7, which further comprises a tensioning winch configured to vary the tension of said pendants, said controller configured to control said tensioning winch to vary the tension of said pendants during use of said crane jib.

* * * * *